US006755238B1

(12) United States Patent
Hirokawa

(10) Patent No.: US 6,755,238 B1
(45) Date of Patent: Jun. 29, 2004

(54) DISINTEGRATIVE CORE FOR HIGH PRESSURE CASTING, METHOD FOR MANUFACTURING THE SAME, AND METHOD FOR EXTRACTING THE SAME

(75) Inventor: Koji Hirokawa, Gumma (JP)

(73) Assignee: Technology Union Co., Ltd., Chonan (KR)

( * ) Notice: Subject to any disclaimer, the term of this patent is extended or adjusted under 35 U.S.C. 154(b) by 0 days.

(21) Appl. No.: 10/019,772

(22) PCT Filed: Jul. 4, 2000

(86) PCT No.: PCT/KR00/00714

§ 371 (c)(1),
(2), (4) Date: May 9, 2002

(87) PCT Pub. No.: WO01/02112

PCT Pub. Date: Jan. 11, 2001

(30) Foreign Application Priority Data

Jul. 6, 1999 (KR) ..... 1999/27082

(51) Int. Cl.[7] ..... B22C 1/02; B22C 9/10; B22D 29/00

(52) U.S. Cl. ..... 164/529; 164/522; 164/132; 164/138; 164/369

(58) Field of Search ..... 164/529, 522, 164/132, 138, 369

(56) References Cited

U.S. PATENT DOCUMENTS 4,556,096 A * 12/1985 Nagata et al. ..... 164/79
4,840,219 A * 6/1989 Foreman ..... 164/369
4,904,423 A * 2/1990 Foreman ..... 264/25

* cited by examiner

*Primary Examiner*—Kiley Stoner
*Assistant Examiner*—I.-H. Lin
(74) *Attorney, Agent, or Firm*—Lowe Hauptman Gilman & Berner LLP

(57) ABSTRACT

Disclosed is a method for manufacturing a disintegrative core for use in high pressure casting. The disintegrative core can be applied where a light metal such as an aluminum alloy or magnesium alloy is subjected to high pressure casting, such as die casting or squeeze casting and is manufactured from a water-soluble salt which is high in latent heat and ranges, in melting point, from 280 to 520° C. and, in heat transfer coefficient (κ), from $9.8\times10^{-2}$ to $1.2\times10$ W/m·° C. The water-soluble salt, alone or in combination with a fine hard powder, is melted and solidified in a core mold. Alternatively, the melt is processed into a fine powder which is then molded in a core mold. The method can be applied for the manufacture of complex shapes of cores. Also, disclosed is a method for extracting such a core from a high pressure molded product.

24 Claims, No Drawings

DISINTEGRATIVE CORE FOR HIGH PRESSURE CASTING, METHOD FOR MANUFACTURING THE SAME, AND METHOD FOR EXTRACTING THE SAME

CROSS-REFERENCE TO RELATED APPLICATIONS

This application is a 371 of PCT/KR00/00714 filed on Jul. 4, 2000.

TECHNICAL FIELD

The present invention relates to a method for manufacturing a disintegrative core for high pressure casting, such as die casting or squeeze casting. More particularly, the present invention relates to the manufacture of complex disintegrative cores from water-soluble salts. Also, the present invention relates to such water-soluble salt cores. In addition, the present invention is concerned with a method for extracting such water-soluble salt cores.

PRIOR ART

Generally, a core preparation technique is necessary to prepare cast articles which have complex internal structures or are undercut.

In the case of gravity casting, a disintegrative core made of hard sand or ceramic powder or a water-soluble salt core is positioned inside a mold, and then a molten metal is introduced and solidified in the mold. After that, the disintegrative core is removed by mechanical and chemical methods or the salt core is melted-out with water or steam.

In the case of a piston for an internal combustion engine, the salt core preparation technique is useful in forming a circular oil cooling gallery inside of the piston.

U.S. Pat No. 3,645,491, the content thereof being incorporated herein by reference, discloses a core preparation technique in which a powdered water-soluble salt is combined with about 10% of synthetic resin as a binding agent U.S. Pat. No. 4,629,708, the content thereof being incorporated herein by reference, discloses a core preparation technique in which a water-soluble salt, such as sodium chloride and potassium chloride, is mixed with ceramics, such as alumina, and silicone resin as a binding agent and sintered.

Under actual circumstances, however, a piston is subjected to high pressure casting, such as die casting and squeeze casting, in order to prepare a high performance aluminum alloy or composite material piston.

In such a high press casting, a conventional disintegrative core made of sand or a conventional salt core cannot be applied to a high pressure casing method because the molten metal penetrates into the inside of the core by cast pressure or the core is collapsed by high pressure.

Recently, there are developed several kinds of core preparation techniques capable of being used where high pressure casting is required. For instance, U.S. Pat. No. 3,963,818, the content thereof being incorporated herein by reference, discloses a core preparation technique in which a powdered water-soluble salt, such as sodium chloride and potassium chloride, is added with about 1% of water, molded under a high pressure of 1.8~4.0 ton/cm$^2$, then sintered at 100~300° C. for 20 minutes.

U.S. Pat. No. 4,438,804, the content thereof being incorporated herein by reference, discloses a core molding method in which a water-soluble salt powder is mixed with hard powder such as Zircon sand, and molded, along with potassium carbonate, barium carbonate or alkali silicate as a binding agent, under a high pressure.

U.S. Pat. No. 3,407,864, the content thereof being incorporated herein by reference, discloses a core molding method in which a water-soluble salt powder, such as sodium chloride and potassium chloride, is mixed with 3 wt % of borax, 1 wt % of magnesium oxide and 1 wt % of talc, and molded under a high pressure.

G.B. Pat. No. 2,156,720, the content thereof being incorporated herein by reference, discloses a core preparation technique in which a powdered water-soluble salt is hydrostatic-pressurized.

In these preparation methods using high pressures or hydrostatic pressures, voids between particles are minimized and their bonding force is strengthened so as for the core to keep its shape unchanged at a cast pressure of 5,000~20,000 psi and so as to prevent the molten metal from penetrating into the inside of the core.

However, these conventional methods suffer from disadvantages in that their application is restricted by the size and shape of cores and the production cost is increased because particle sizes of salt powders are required to be finely controlled.

In addition, it takes a significant amount of time to completely remove cores from the high pressure cast articles because the cores are dissolved with water.

Meanwhile, U.S. Pat. Nos. 4,446,906, 4,875,517, and 5,303,761, the contents thereof being incorporated herein by reference, disclose core preparation methods in which a water-soluble salt such as sodium chloride and potassium chloride are heated, melted, and subjected to die casting, optionally in combination with hard particles, such as silica and alumina.

Somewhat superior as it is to molding methods in core shape and productivity, these conventional methods are limited in their application by the size of the core. In addition, the conventional methods require a significant amount of time to completely remove cores from high pressure cast articles when water is used to dissolve the cores.

U.S. Pat No. 4,840,219, the content thereof being incorporated herein by reference, discloses a method in which a molten salt of a mixture comprising 40% by weight of NaCl and 40% by weight of $Na_2CO_3$ is added with 10~50% of hard powder to give a slurry which is introduced into a mold. U.S. Pat. No. 3,459,253, the content thereof being incorporated herein by reference, discloses a method in which wire or glass fiber is added to the molten mixture salt comprising sulfate salt and carbonate salt to give a slurry which is introduced into a mold.

These methods have more variety in shape and size of the core than does the pressurization method or the die cast method. Meanwhile, because the used salts are as high as above 660° C. in melting temperatures, cracks are easily caused owing to the shrinkage upon solidification so that the cores become brittle and are difficult to handle. Additionally, a substantial period of time is required to remove the cores of high pressure cast articles because the cores must be dissolved by use of water, and the core salts thus obtained cannot be re-used.

DISCLOSURE OF THE PRESENT INVENTION

In view of the aforementioned problems and considerations, it is an object of the present invention to provide a method for manufacturing a disintegrative core for high pressure casting, capable of simply manufacturing a core of a complex shape and obtaining a core for high pressure casting by use of a re-usable aluminum alloy or a magnesium alloy.

It is another object of the present invention to provide a disintegrative core for high pressure casting.

It is a further object of the present invention to provide a method for extracting the core.

In one embodiment, one of the objects of the present invention is realized by the method for manufacturing the disintegrative core for high pressure case wherein a water-soluble salt, alone or in combination with a fine hard powder, is melted and solidified in a core mold; or processed into a fine powder and molded in a core mold under pressure, said water soluble salt ranging from 280 to 520° C. in melting point and from $9.8\times10^{-2}$ to $1.2\times10$ W/m·° C. in heat transfer coefficient (κ) with a high latent heat, whereby the disintegrative core is manufactured from the water-soluble salt.

In another embodiment, another object of the present invention is embodied by the disintegrative core for high pressure casting manufactured through the said method.

In a further embodiment, the other object is realized by the method for extracting the disintegrative core for high pressure casting from a high pressure cast article, wherein the core is heated to a melting temperature at which the high pressure cast article is not thermally deformed, the core melt is extracted, and the cast article is washed with water.

BEST MODES CARRYING OUT THE PRESENT INVENTION

Hereinafter, the present invention describes a disintegrative core for high-pressure casting, and methods for manufacturing and extracting the same.

A disintegrative core for high pressure casting is manufactured from a water-soluble salt, wherein the water-soluble salt, alone or in combination with a fine hard powder, is melted and solidified in a core mold; or processed into a fine powder and molded in a core mold under a pressure, said water soluble salt ranging from 280 to 520° C. in melting point and from $9.8\times10^{-2}$ to $1.2\times10$ W/m·° C. in heat transfer coefficient (κ) with a high latent heat, whereby the disintegrative core can be applied where a light metal such as aluminum alloy or magnesium alloy is subjected to high pressure casting, such as die casting or squeeze casting.

As having a melting point of 280 to 520° C. and a heat transfer coefficient (κ) of $9.8\times10^{-2}$ to $1.2\times10$ W/m·° C. and being high in latent heat, the water-soluble salt is selected from the group consisting of potassium nitrate ($KNO_3$), potassium nitrite ($KNO_2$), sodium, nitrate ($NaNO_3$), sodium nitrite ($NaNO_2$), copper chloride ($CuCl_2$), sodium chloride (NaCl), potassium chloride (KCl), lithium chloride (LiCl), lead chloride $PbCl_2$), magnesium chloride ($MgCl_2$), barium chloride ($BaCl_2$), calcium chloride ($CaCl_2$) and mixtures thereof.

In regard to melting point, 333° C. is known for potassium nitrate ($KNO_3$), 290° C. for potassium nitrite ($KNO_2$), 308° C. for sodium nitrate ($NaNO_3$) and 270° C. for sodium nitrite ($NaNO_2$).

315° C. is measured to be the melting temperature for the mixture salt comprising, by weight ratio, 82:17 NaCl:$CuCl_2$, 320° C. for the mixture salt comprising, by weight ratio, 92:8 $KNO_3$:KCl, 320° C. for the mixture salt comprising, by weight ratio, 54:46 KCl:LiCl, 410° C. for the mixture salt comprising, by weight ratio, 93:7 $PbCl_2$:NaCl, 430° C. for the mixture salt comprising, by weight ratio, 54:44 $MgCl_2$:NaCl, 450° C. for the mixture salt comprising, by weight ratio, 53:47 $CaCl_2$:$BaCl_2$ and 510° C. for the mixture salt comprising, by weight ratio, 54:46 NaCl:$CaCl_2$, and each salt ranges from $9.8\times10^{-2}$ to $1.2\times10$ W/m·° C. in heat transfer coefficient (κ).

Such a water-soluble salt is solidified in a mold. At this time, the molten water-soluble salt is introduced into the mold at a temperature higher by about 30~80° C. than that of its melting temperature, thereby minimizing the occurrence of cracks attributed to the shrinkage upon solidification.

In this regard, if the temperature of the molten water-soluble salt is above 80° C., shrinkage-attributable cracks and pores are generated upon solidification. On the other hand, if the temperature is below 30° C., the water-soluble salt is difficult to inject into a mold.

In addition, the mold temperature is controlled not to exceed half of the melting point of each salt to be introduced. The reason is that, if the mold temperature is lower, the salt is not well introduced into the mold. On the other hand, if the temperature of the mold is higher, the surface structure of the solidified core becomes so coarse that a thermal deformation occurs in deep parts of the core upon high pressure casting.

Accordingly, suitable for mold material is graphite, which is excellent in thermal conductivity. When the mold is made of graphite, the molten salt is easily introduced into the mold and the solidification rate becomes so fast that the surface texture of the solidified core is made fine.

In the molten salt, fine thermostable hard particles such as powders, fibers and whiskers of chemically non-reactive metals or ceramics, may be added. For use, they are homogeneously dispersed.

By way of examples, and not limitation, suitable for metal particles is silicon with a high solidity and a similar specific gravity to that of the salt Also, alumina ($Al_2O_3$), silicon carbide (SiC) and so on can be used as the ceramic particles. Such fibers or whiskers can be used.

The hard particles are preferably added at an amount of 5~30 wt %. If the added amount of the hard particles is above 30 wt %, the shrinkage upon solidification can be inhibited and a strength of the core attributed to dispersion effect becomes high. But it suffers from a problem of the hard particles partly adhering onto a surface of a high pressure cast article. On the other hand, if the added amount is below 5 wt %, the addition effect of the hard particles cannot be obtained.

The water-soluble salt is processed into a powder, introduced into a core mold and molded to a core. In this regard, it is extremely preferred that the water-soluble salt powder has a size of 40~100 μm for the molding under pressure. Also, a lubricant not chemically reacting with the salt is preferably used so as to facilitate the separation of the cast article from the mold.

At this time, it is preferred that the molding pressure resulting from the pressurization ranges from 60 to 100 Mpa. In addition, the molded core is preferably kept at its melting point for 0.5~1 minute, so as to make the surface texture of the core fine.

The core obtained according to the method of the present invention can be used where a metal alloy such as an aluminum alloy or a magnesium alloy is subjected to high pressure casting.

Upon the high pressure casting of a metal with a low thermal capacity, such as an aluminum alloy and a magnesium alloy, the mold is instantly filled with the melt within 0.5~3 seconds. Because the metal alloy such as an aluminum alloy or a magnesium alloy, although having a melting point (280~520° C.) lower than a usual casting temperature (640~720° C.) of common molten metals, has a heat transfer coefficient (κ) ($9.8\times10^{-2}$~$1.2\times10$ W/m·° C.) which is only 1/1500~1/3000 of that (331~403 W/m·° C.) of steel, which is a typical material for high pressure casting molds. The molten alloy is drastically cooled as soon as it is introduced into the mold.

In detail, because the core is lower in thermal conductivity than is steel, a material for the mold, most of the heat that the melt retains is transferred toward the mold while the beat is hardly transferred toward the core. Meanwhile, the high latent heat of the core permits a thermal deformation to occur only in the surface down to a depth of 2–3 μm but not in the total shape. In other words, the core is not deformed, nor changed in its total shape by virtue of its high latent heat.

In such general casting as high pressure casting which is instantly completed, the water-soluble salts of the present invention are suitable as cores for casting metals with low thermal capacity such as aluminum and magnesium.

Meanwhile, a method for removing the core from a high pressure cast article, that is to say, a method for extracting the core from the cast article, is conducted by heating the core to a melting temperature at which the high pressure cast article is not thermally deformed, extracting the core melt, and washing the cast article with water.

When the high pressure cast article is heated at 320~550° C. for 3~5 minutes, the heat is transferred to the inside of the core so that the core is melted and extracted. The material thus obtained can be re-used in molding of the core to bring about an economical favor.

A better understanding of the present invention may be obtained in light of the following examples which are set forth to illustrate, but are not to be construed to limit the present invention.

EXAMPLE 1

$KNO_3$ (m.p. 333° C.), $KNO_2$ (m.p. 290° C.), $NaNO_3$ (m.p. 308° C.), $NaNO_2$ (m.p. 270° C.), a mixture of 82:17 NaCl:$CuCl_2$ (m.p. 315° C.), a mixture of 92:8 $KNO_3$:KCl (m.p. 320° C.), a mixture of 54:46 KCl:LiCl (m.p. 320° C.), a mixture of 93:7 $PbCl_2$:NaCl (m.p. 410° C.), a mixture of 54:44 $MgCl_2$:NaCl (m.p. 430° C.), a mixture of 53:47 $CaCl_2$:$BaCl_2$ (m.p. 450° C.), and a mixture of 54:46 NaCl:$CaCl_2$ (m.p. 510° C.) were individually heated at temperatures which were higher by about 30~80° C. than their melting points, respectively. Each of the molten salts was slowly introduced into a mold and separately into a graphite mold, both of which were preheated to half of the melting point of the salt, to manufacture a cylindrical core with a diameter of 20 mm and a length of 100 mm.

The resulting core was subjected to die casting and squeeze casting in the mold whose wall was set to be spaced from the core at a distance of 3 mm, 5 mm, 7 mm, 9 mm, 12 mm, and 15 mm, and measured for its performance. Results are given in Tables 1 and 2, below.

For assaying the performance of the core, ADC12 Al alloy heated to 670° C. was subjected to high pressure casting under conditions of 1.8 m/sec in feeding rate of a melt for die casting, 0.32 m/sec in feeding rate of a melt for squeeze casting, and 980 kg/cm$^2$ in pressure for die casting and squeeze casting. After the high pressure casting, the extraction of the core was achieved by heating the high pressure cast article at 320~550° C. for 3~5 minutes, melting the core, and washing the cast article with water.

TABLE 1

Performance of Cores Prepared in Steel Mold

| | Die Casting (Gap between core and mold, mm) | | | | | | Squeeze Casting (Gap between core and mold, mm) | | | | | |
|---|---|---|---|---|---|---|---|---|---|---|---|---|
| Cores | 3 | 5 | 7 | 9 | 12 | 15 | 3 | 5 | 7 | 9 | 12 | 15 |
| $NaNO_2$ | O | O | x | x | x | x | O | x | x | x | x | x |
| $KNo_2$ | O | O | x | x | x | x | O | x | x | x | x | x |
| $NaNO_3$ | O | O | O | x | x | x | O | x | x | x | x | x |
| NaCl:CuCl (82:17) | O | O | O | x | x | x | O | x | x | x | x | x |
| $KNO_3$:KCl (92:8) | O | O | O | O | x | x | O | O | x | x | x | x |
| KCl:LiCl (54:46) | O | O | O | O | x | x | O | O | x | x | x | x |
| $KNo_3$ | O | O | O | O | O | x | O | O | O | x | x | x |
| $PbCl_2$:NaCl (93:7) | O | O | O | O | O | O | O | O | O | O | x | x |
| $MgCl_2$:NaCl (54:44) | O | O | O | O | O | O | O | O | O | O | O | x |
| $CaCl_2$:$BaCl_2$ (53:47) | O | O | O | O | O | O | O | O | O | O | O | x |
| NaCl:$CaCl_2$ (54:46) | O | O | O | O | O | O | O | O | O | O | O | x |

Note)
O: suitable (good surface condition)
x: unsuitable (poor surface condition)

TABLE 2

Performance of Cores Prepared in Graphite Mold

| | Die Casting (Gap between core and mold, mm) | | | | | | Squeeze Casting (Gap between core and mold, mm) | | | | | |
|---|---|---|---|---|---|---|---|---|---|---|---|---|
| Cores | 3 | 5 | 7 | 9 | 12 | 15 | 3 | 5 | 7 | 9 | 12 | 15 |
| $NaNO_2$ | O | O | O | x | x | x | O | x | x | x | x | x |
| $KNo_2$ | O | O | O | O | x | x | O | x | x | x | x | x |
| $NaNO_3$ | O | O | O | O | x | x | O | O | x | x | x | x |
| NaCl:CuCl (82:17) | O | O | O | O | O | x | O | O | O | x | x | x |
| $KNO_3$:KCl (92:8) | O | O | O | O | x | x | O | O | O | x | x | x |
| KCl:LiCl (54:46) | O | O | O | O | O | x | O | O | O | x | x | x |
| $KNo_3$ | O | O | O | O | O | O | O | O | O | O | x | x |
| $PbCl_2$:NaCl (93:7) | O | O | O | O | O | O | O | O | O | O | x | x |
| $MgCl_2$:NaCl (54:44) | O | O | O | O | O | O | O | O | O | O | O | x |
| $CaCl_2$:$BaCl_2$ (53:47) | O | O | O | O | O | O | O | O | O | O | O | x |
| NaCl:$CaCl_2$ (54:46) | O | O | O | O | O | O | O | O | O | O | O | x |

Note)
O: suitable (good surface condition)
x: unsuitable (poor surface condition)

EXAMPLE 2

$KNO_3$ (m.p. 333° C.), $KNO_2$ (m.p. 290° C.), $NaNO_3$ (m.p. 308° C.), $NaNO_2$ (m.p. 270° C.), a mixture of 82:17 NaCl:$CuCl_2$ (m.p. 315° C.), a mixture of 92:8 $KNO_3$:KCl (m.p. 320° C.), a mixture of 54:46 KCl:LiCl (m.p. 320° C.), a mixture of 93:7 $PbCl_2$:NaCl (m.p. 410° C.), a mixture of 54:44 $MgCl_2$:NaCl (m.p. 430° C.), a mixture of 53:47 $CaCl_2$:$BaCl_2$ (m.p. 450° C.), and a mixture of 54:46 NaCl:$CaCl_2$ (m.p. 510° C.) were individually heated at temperatures which were higher by about 30~80° C. than their melting points, respectively. 20~30 wt % of Alumina ($Al_2O_3$: Isolite.Co.Ltd., Japan) which was 40~100 μm in diameter was added to the heated solution and homogeneously dispersed. Then, this dispersion was slowly introduced into a graphite mold which was preheated to half of each melting point, to manufacture a cylindrical core with a diameter of 20 mm and a length of 100 mm.

Likewise, 5~15 wt % of silicon carbide whisker (SiC: TongHae Carbon Co. Ltd., Japan) which was 0.5~1 μm in diameter and 100~400 μm in length was homogeneously dispersed to manufacture a core.

The resulting core was subjected to die casting and squeeze casting in the mold whose wall was set to be spaced from the core at a distance of 3 mm, 5 mm, 7 mm, 9 mm, 12 mm, and 15 mm, and measured for its performance. Results are given in Table 3, below.

For assaying the performance of the core, ADC12 Al alloy heated to 670° C. was subjected to high pressure casting under conditions of 1.8 m/sec in feeding rate of a melt for die casting, 0.32 m/sec in feeding rate of a melt for squeeze casting, and 980 kg/cm$^2$ in pressure for die casting and squeeze casting. After the high pressure casting, the extraction of the core was achieved by heating the high pressure cast article at 320~550° C. for 3~5 minutes, melting the core, and washing the cast article with water.

TABLE 3

Performance of Cores Prepared from Mixtures of Hard Particles in Graphite Mold

| | Die Casting (Gap between core and mold, mm) | | | | | | Squeeze Casting (Gap between core and mold, mm) | | | | | |
|---|---|---|---|---|---|---|---|---|---|---|---|---|
| Cores | 3 | 5 | 7 | 9 | 12 | 15 | 3 | 5 | 7 | 9 | 12 | 15 |
| $NaNO_2$ + $Al_2O_3$ | O | O | O | O | x | x | O | O | x | x | x | x |
| $KNO_2$ + SiC | O | O | O | O | x | x | O | O | x | x | x | x |
| $NaNO_3$ + $Al_2O_3$ | O | O | O | O | x | x | O | O | O | x | x | x |
| NaCl:CuCl (82:17) + $Al_2O_3$ | O | O | O | O | O | x | O | O | O | x | x | x |
| $KNO_3$:KCl (92:8) + $Al_2O_3$ | O | O | O | O | O | x | O | O | O | O | x | x |
| KCl:LiCl (54:46) + SiC | O | O | O | O | O | O | O | O | O | O | O | x |
| $KNO_3$ + SiC | O | O | O | O | O | O | O | O | O | O | O | x |
| $PbCl_2$:NaCl (93:7) + $Al_2O_3$ | O | O | O | O | O | O | O | O | O | O | O | O |
| $MgCl_2$:NaCl (54:44) + SiC | O | O | O | O | O | O | O | O | O | O | O | O |
| $CaCl_2$:$BaCl_2$ (53:47) + SiC | O | O | O | O | O | O | O | O | O | O | O | O |
| NaCl:$CaCl_2$ (54:46) + $Al_2O_3$ | O | O | O | O | O | O | O | O | O | O | O | O |

Note)
O: suitable (good surface condition)
x: unsuitable (poor surface condition)

EXAMPLE 3

$KNO_3$ (m.p. 333° C.), $KNO_2$ (m.p. 290° C.), $NaNO_3$ (m.p. 308° C.), $NaNO_2$ (m.p. 270° C.), a mixture of 82:17 NaCl:$CuCl_2$ (m.p. 315° C.), a mixture of 92:8 $KNO_3$:KCl (m.p. 320° C.), a mixture of 54:46 KCl:LiCl (m.p. 320° C.), a mixture of 93:7 $PbCl_2$:NaCl (m.p. 410° C.), a mixture of 54:44 $MgCl_2$:NaCl (m.p. 430° C.), a mixture of 53:47 $CaCl_2$:$BaCl_2$ (m.p. 450° C.), and a mixture of 54:46 NaCl:$CaCl_2$ (m.p. 510° C.) were ground to particle sizes of about 40~100 μm added with 1 wt % of talc as a lubricant and pressurized to a pressure of 80~100 Mpa, to mold a cylindrical core with a diameter of 20 mm and a length of 100 mm. The molded core was kept at the melting point of each salt for 0.5~1 minute to manufacture a core.

15 wt % of Alumina ($Al_2O_3$: Isolite.Co.Ltd., Japan) which was 40~100 μm in diameter and 8 wt % of silicon carbide whisker (SiC: TongHae Carbon Co. Ltd., Japan) which was 0.5~1 μm in diameter and 100~400 μm in length were added to the salt powder and homogeneously mixed to manufacture a core.

The resulting core was subjected to die casting and squeeze casting in the mold whose wall was set to be spaced from the core at a distance of 3 mm, 5 mm, 7 mm, 9 mm, 12 mm, and 15 mm, and measured for its performance. Results are given in Table 4, below.

For assaying the performance of the core, ADC12 Al alloy heated to 670° C. was subjected to high pressure casting under conditions of 1.8 m/sec in feeding rate of a melt for die casting, 0.32 m/sec in feeding rate of a melt for squeeze casting, and 980 kg/cm$^2$ in pressure for die casting and squeeze casting. After the high pressure casting, the extraction of the core was achieved by heating the high pressure cast article at 320~550° C. for 3~5 minutes, melting the core, and washing the cast article with water.

TABLE 4

Performance of Cores Molded from Mixtures of Hard Particles Under Pressure

| | Die Casting (Gap between core and mold, mm) | | | | | | Squeeze Casting (Gap between core and mold, mm) | | | | | |
|---|---|---|---|---|---|---|---|---|---|---|---|---|
| Cores | 3 | 5 | 7 | 9 | 12 | 15 | 3 | 5 | 7 | 9 | 12 | 15 |
| $NaNO_2$ + $Al_2O_3$ | O | O | O | O | x | x | O | O | O | x | x | x |
| $KNO_2$ + SiC | O | O | O | O | x | x | O | O | O | x | x | x |
| $NaNO_3$ + $Al_2O_3$ | O | O | O | O | O | x | O | O | O | O | x | x |
| NaCl:CuCl (82:17) + $Al_2O_3$ | O | O | O | O | O | x | O | O | O | O | x | x |
| $KNO_3$:KCl (92:8) + $Al_2O_3$ | O | O | O | O | x | x | O | O | O | O | x | x |
| KCl:LiCl (54:46) + SiC | O | O | O | O | O | x | O | O | O | O | O | x |
| $KNO_3$ + SiC | O | O | O | O | O | O | O | O | O | O | O | x |
| $PbCl_2$:NaCl (93:7) + $Al_2O_3$ | O | O | O | O | O | O | O | O | O | O | O | O |
| $MgCl_2$:NaCl (54:46) + SiC | O | O | O | O | O | x | O | O | O | O | O | x |
| $CaCl_2$:$BaCl_2$ (53:47) + SiC | O | O | O | O | O | O | O | O | O | O | O | O |
| NaCl:$CaCl_2$ (54:46) + $Al_2O_3$ | O | O | O | O | O | O | O | O | O | O | O | O |

Note)
O: suitable (good surface condition)
x: unsuitable (poor surface condition)

INDUSTRIAL APPLICABILITY

As described hereinbefore, cores of complex shapes can be simply manufactured from a water-soluble salt, wherein the water-soluble salt, alone or in combination with a fine hard powder, is melted and solidified in a core mold, the salt ranging from 280 to 520° C. in melting point and from $9.8\times10^{-2}$ to $1.2\times10$ W/m·° C. in heat transfer coefficient (κ) with a high latent heat. In addition, the core can be applied where light metal, such as aluminum alloy or magnesium alloy, is subjected to high pressure casting, such as die casting and squeeze casing. Finally, the core, heated and melted and extracted, can be re-used so as to bring about an economical favor.

What is claimed is:

1. A mixture for preparing a disintegrative casting core for high pressure casting, the mixture comprising:

a) 70–95% by weight of a fusible, water-soluble salt or salts; and b) 5–30% by weight of chemically non-reactive, fine hard particles, said fine hard particles being selected from the group consisting of powders, fibers, and whiskers of metal ceramics and mixtures thereof; and wherein the mixture has a melting point in the range from 280 to 520° C. and a heat conductive coefficient (κ) in the range from $9.8\times10^{-2}$ to $1.2\times10$ W/m·° C., and having a high heat latent heat for melting; and wherein said fusible, water-soluble salt or salts is selected from the group consisting of CuCl, $PbCl_2$, a mixture of NaCl (82% by weight) and CuCl (18% by weight), a mixture of $KNO_3$ (92% by weight), and KCl (8% by weight), a mixture of KCl (54% by weight) and LiCl (46% by weight), a mixture of $MgCl_2$ (54% by weight) and NaCl (46% by weight), a mixture of $CaCl_2$ (53% by weight) and $BaCl_2$ (47% by weight) and a mixture of NaCl (54% by weight) and $CaCl_2$ (46% by weight).

2. The mixture of claim 1, wherein the fusible, water-soluble salt or salts is a mixture of NaCl (82% by weight) and CuCl (18% by weight).

3. The mixture of claim 1, wherein the fusible, water-soluble salt or salts is a mixture of $KNO_3$ (92% by weight) and KCl (8% by weight).

4. The mixture of claim 1, wherein the fusible, water-soluble salt or salts is a mixture of KCl (54% by weight) and LiCl (46% by weight).

5. The mixture of claim 1, wherein the fusible, water-soluble salt or salts is a mixture of $CaCl_2$ (83% by weight) and $BaCl_2$ (47% by weight).

6. The mixture of claim 1, wherein the fusible, water-soluble salt or salts is a mixture of NaCl (54% by weight) and $CaCl_2$ (46% by weight).

7. The mixture of claim 1, wherein the fusible, water-soluble salt is CuCl.

8. The mixture of claim 1, wherein the fusible, water-soluble salt is $PbCl_2$.

9. The mixture of claim 1, wherein the fusible, water-soluble salt or salts has a particle size of about 40 to 100 μm.

10. The mixture of claim 1, wherein the chemically non-reactive, fine hard particles are alumina ($Al_2O_3$) particles which are about 40–100 μm in diameter.

11. The mixture of claim 1, wherein the chemically non-reactive, fine hard particles are silicon carbide (SiC) particles which are about 0.5–1 μm in diameter, and about 100–400 μm in length.

12. A disintegrative core for high pressure casting comprising:

a) 70–95% by weight of a fusible, water-soluble salt or salts; and b) 5–30% by weight of chemically non-reactive, fine hard particles, said fine hard particles being selected from the group consisting of powders, fibers, and whiskers of metal ceramics and mixtures thereof; and wherein the mixture has a melting point in the range from 280 to 520° C. and a heat conductive coefficient (κ) in the range from $9.8\times10^{-2}$ to $1.2\times10$ W/m·° C., and having a high heat latent heat for melting; and wherein said fusible, water-soluble salt or salts is selected from the group consisting of CuCl, $PbCl_2$, a mixture of NaCl (82% by weight) and CuCl (18% by weight), a mixture of $KNO_3$ (92% by weight), and KCl (8% by weight), a mixture of KCl (54% by weight) and LiCl (46% by weight), a mixture of $MgCl_2$ (54% by weight) and NaCl (46% by weight), a mixture of $CaCl_2$ (53% by weight) and $BaCl_2$ (47% by weight) and a mixture of NaCl (54% by weight) and $CaCl_2$ (46% by weight).

13. The disintegrative core of claim 12, wherein the fusible, water-soluble salt or salts is a mixture of NaCl (82% by weight) and CuCl (18% by weight).

14. The disintegrative core of claim 12, wherein the fusible, water-soluble salt or salts is a mixture of $KNO_3$ (92% by weight) and KCl (8% by weight).

15. The disintegrative core of claim 12, wherein the fusible, water-soluble salt or salts is a mixture of KCl (54% by weight) and LiCl (46% by weight).

16. The disintegrative core of claim 12, wherein the fusible, water-soluble salt or salts is a mixture of $CaCl_2$ (83% by weight) and $BaCl_2$ (47% by weight).

17. The disintegrative core of claim 12, wherein the fusible, water-soluble salt or salts is a mixture of NaCl (54% by weight) and $CaCl_2$ (46% by weight).

18. The disintegrative core of claim 12, wherein the fusible, water-soluble salt is CuCl.

19. The disintegrative core of claim 12, wherein the fusible, water-soluble salt is $PbCl_2$.

20. The disintegrative core of claim 12, wherein the fusible, water-soluble salt or salts has a particle size of about 40 to 100 μm.

21. The disintegrative core of claim 12, wherein said chemically non-reactive, fine hard particles are alumina ($Al_2O_3$) particles which are about 40–100 μm in diameter.

22. The disintegrative core of claim 12, wherein said chemically non-reactive, fine hard particles are silicon carbide (SiC) particles which are about 0.5–1 μm in diameter, and about 100–400 μm in length.

23. A method for preparing a disintegrative core for high pressure casting comprising the steps of:

a) providing a mixture comprising 70–95% by weight of a fusible, water-soluble salt or salts; and 5–30% by weight of chemically non-reactive, fine hard particles, said fine hard particles being selected from the group consisting of powders, fibers, and whiskers of metal ceramics and mixtures thereof; and wherein the mixture has a melting point in the range from 280 to 520° C. and a heat conductive coefficient (κ) in the range from $9.8\times10^{-2}$ to $1.2\times10^{1}$W/m·° C., and having a high heat latent heat for melting, and wherein said fusible, water-soluble salt or salts is selected from the group consisting of CuCl, $PbCl_2$, a mixture of NaCl (82% by weight) and CuCl (18% by weight), a mixture of $KNO_3$ (92% by weight), and KCl (8% by weight), a mixture of KCl (54% by weight) and LiCl (46% by weight), a mixture of $MgCl_2$ (54% by weight) and NaCl (46% by weight), a mixture of $CaCl_2$ (53% by weight) and $BaCl_2$ (47% by weight) and a mixture of NaCl (54% by weight) and $CaCl_2$ (46% by weight);

b) melting the mixture at the temperature higher by 30–80° C. than that of the melting point thereof;

c) casting the molten mixture into a mold made of graphite which is preheated to half of the melting point of the mixture;

d) cooling the mold and the core contained therein; and e) removing the cooled core from the mold.

24. A method for preparing a disintegrative core high pressure casting comprising the steps of:

a) providing a mixture comprising 70–95% by weight of a fusible, water-soluble salt or salts; and 30% by weight of a chemically con-reactive, fine hard particles, said fine hard particles being selected from the group consisting of powders, fibers, and whiskers of metal ceramics and mixtures thereof; and wherein the mixture has a melting point in the range from 280 to 520° C. and a heat conductive coefficient (κ) in the range from $9.8\times10^{-2}$ to $1.2\times10$ W/m·° C., and having a high heat latent heat for melting, and wherein said fusible, water-soluble salt(s) is selected from the group consisting of CuCl, PbCl2, a mixture of NaCl (82% by weight) and CuCl (18% by weight), a mixture of $KNO_3$ (92% by weight), and KCl (8% by weight), a mixture of KCl (54% by weight) and LiCl (46% by weight), a mixture of $MgCl_2$ (54% by weight) and NaCl (46% by weight), a mixture of $CaCl_2$ (53% by weight) and $BaCl_2$ (47% by weight) and a mixture of NaCl (54% by weight) and $CaCl_2$ (46% by weight);

b) grinding the mixture into a powder with a particle size of about 40–100 μm;

c) introducing the powder into the mold;

d) pressuring the powder in the mold under a pressure of about 80–100 Mpa; and e) removing the cooled core form the mold.

* * * * *